US005316299A

United States Patent [19]

Feche et al.

[11] Patent Number: 5,316,299

[45] Date of Patent: May 31, 1994

[54] GOLF CLUB SHAFT

[75] Inventors: Pierre Feche, Cran-Gevrier; Jean-Luc Veux, Rumilly, both of France

[73] Assignee: Taylor Made Golf Company, Carlsbad, Calif.

[21] Appl. No.: 961,620

[22] Filed: Oct. 16, 1992

[30] Foreign Application Priority Data

Oct. 16, 1991 [FR] France ..... 91 12937

[51] Int. Cl.[5] ..... A63B 53/10

[52] U.S. Cl. ..... 273/80 R; 273/80 B

[58] Field of Search ..... 273/80 R–80 D, 273/81 R–81 D, 165, 80.2–80.9

[56] References Cited

U.S. PATENT DOCUMENTS

| | | | |
|---|---|---|---|
| 1,565,070 | 12/1925 | Edwards | 273/80 R |
| 1,604,696 | 10/1926 | Jordy | 273/81 B |
| 1,639,864 | 8/1927 | Smith | 273/80 R |
| 2,050,554 | 8/1936 | Barnhart | 273/80.2 |
| 2,250,429 | 7/1941 | Vickery | 273/80 B |
| 3,083,969 | 4/1963 | Bills | 273/80 B |
| 3,313,541 | 4/1967 | Benkoczy et al. | 273/80 R |
| 3,614,101 | 10/1971 | Hunter | 273/80 CX |

FOREIGN PATENT DOCUMENTS

| | | | |
|---|---|---|---|
| 24144 | 1/1911 | United Kingdom | 273/80 R |
| 360097 | 11/1931 | United Kingdom | 273/81 R |
| 439308 | 12/1935 | United Kingdom . | |
| 447496 | 5/1936 | United Kingdom | 273/80 R |
| 1201648 | 8/1970 | United Kingdom | 273/80 R |
| 1446444 | 8/1976 | United Kingdom . | |

*Primary Examiner*—Jessica J. Harrison
*Assistant Examiner*—Sebastiano Passaniti
*Attorney, Agent, or Firm*—Pollock, Vande Sande & Priddy

[57] ABSTRACT

A golf club comprising a shaft made of a composite material with a head (2) at its lower end and a grip (3) at its upper end. The shaft comprises three distinct sections, namely (a) a first, upper tapered portion (12*a*) covered by the grip, (b) a second, lower portion (12*b*) extending to the lower portion (10) of the shaft, and (c) a third connecting portion attaching the first to the second portions. The diameter (d1) of the section of the lower end of the first portion (12*a*) is smaller than the diameter (d2) of the section of the upper end of the second portion (12*b*).

9 Claims, 5 Drawing Sheets

GOLF CLUB SHAFT

FIELD OF THE INVENTION

The present invention relates to a golf club and to a shaft made of a composite material equipping this club.

BACKGROUND OF THE INVENTION

A golf club basically comprises a shaft carrying, at its lower end, a head or striking component, and, at its upper end, a handle, commonly termed a "grip."

Conventional golf clubs generally have tapered shafts made of steel, metal alloys, or composite materials. They have a shape whose section changes continuously and whose maximum dimension is measured at the grip, or handle, and whose minimum dimension is measured at the neck, where the club head is attached. This is the most widely used type of shaft.

If one wishes to enhance the mechanical properties of the club, i.e., the elastic line under torsion and/or flection of the shaft, while preserving a club having satisfactory ergonomic qualities in the gripping area of the club, the geometries of conventional shafts offer few opportunities other than the use of fibers having a higher modulus, which is costly, or the incorporation of additional reinforcements of fiber layers which adds undesirable surplus weight.

SUMMARY OF THE INVENTION

One of the objects of the invention is to solve this problem, which results basically from the geometry of the shaft and from the design of the various club components.

The club according to the invention has mechanical properties superior to those of conventional clubs, while preserving satisfactory ergonomic properties and lightness.

To this end, the club incorporates a shaft made of a composite material, at the end of which a grip is mounted. This shaft comprises a first, upper tapered portion extending from the upper end and at least partially covered by the grip; a second, lower portion extending to the lower end; and a third, connecting portion. The club is characterized by the fact that the diameter of the section of the lower end of the first of these portion is smaller than the diameter of the section of the upper end of the second, portion.

BRIEF DESCRIPTION OF THE DRAWINGS

The invention will be better understood and other advantages and features will better emerge from the embodiments described below and illustrated by the following drawings, in which.

DESCRIPTION OF PREFERRED EMBODIMENTS

Figure 1:
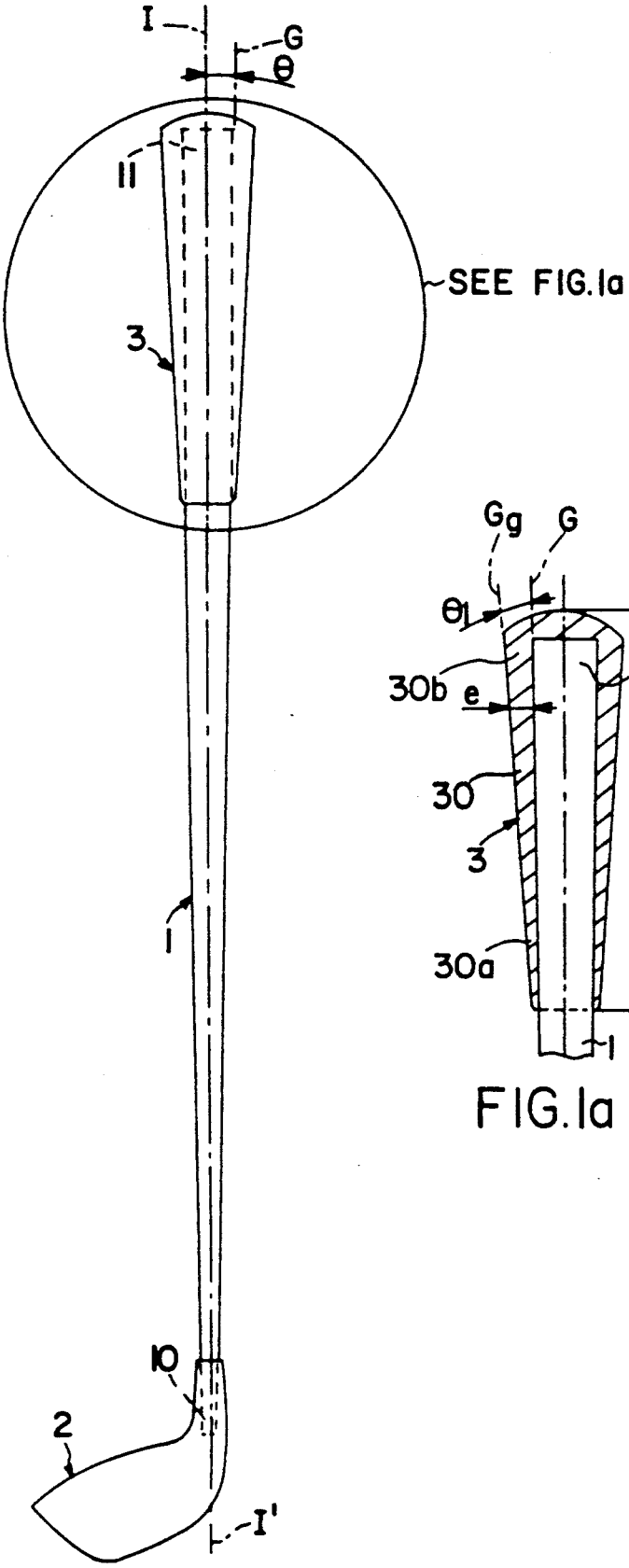
FIG. 1 is a view of a golf club according to prior art.
Figure 1A:
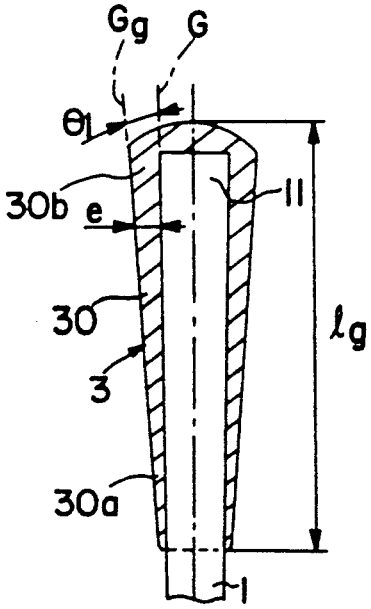
FIG. 1*a* is a detail view of the club according to FIG. 1.
Figure 1B:
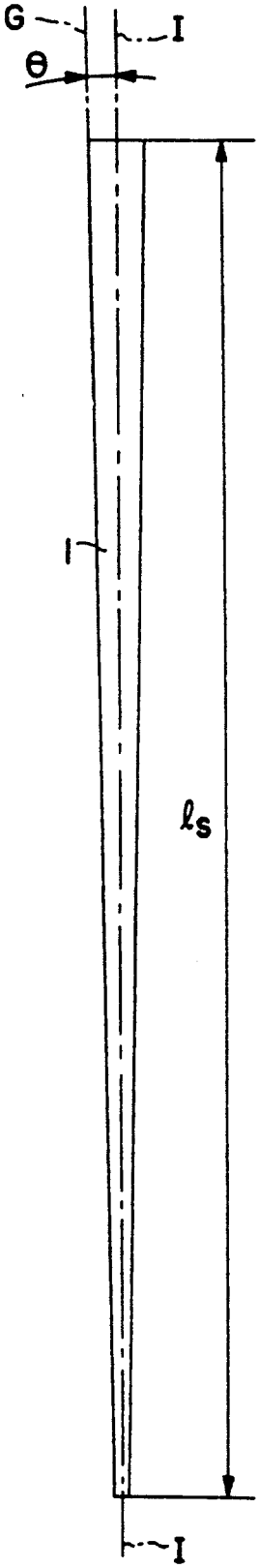
FIG. 1*b* is a view of a shaft of the club shown in FIG. 1.

As illustrated in FIGS. 1 and 1*a*, the golf club according to prior art is constituted by a shaft 1 whose overall shape is uniformly tapered, i.e., in which the generating line G of the shaft forms, with the longitudinal axis I, I', a positive angle $\theta$, as shown in FIGS. 1 to 1*b*. A head 2 is attached to the lower end 10 of this shaft 1, and a grip 3 having a length lg and extending over a portion of the shaft is fitted on its upper end 11. The grip has a tubular wall 30 of variable thickness e, in particular a thickness which increases from the lower end 30*a* to the upper end 30*b* of the tubular wall 30. The thickness is an average of approximately 5 to 6 mm at the upper end 30*b*, and diminishes to reach values of approximately 1.5 to 2 mm at the lower end. This also means that the generating line Gg of the outer surface of the tubular wall 30 is offset from the generating line G by a positive angle $\theta$1.

Figure 2:
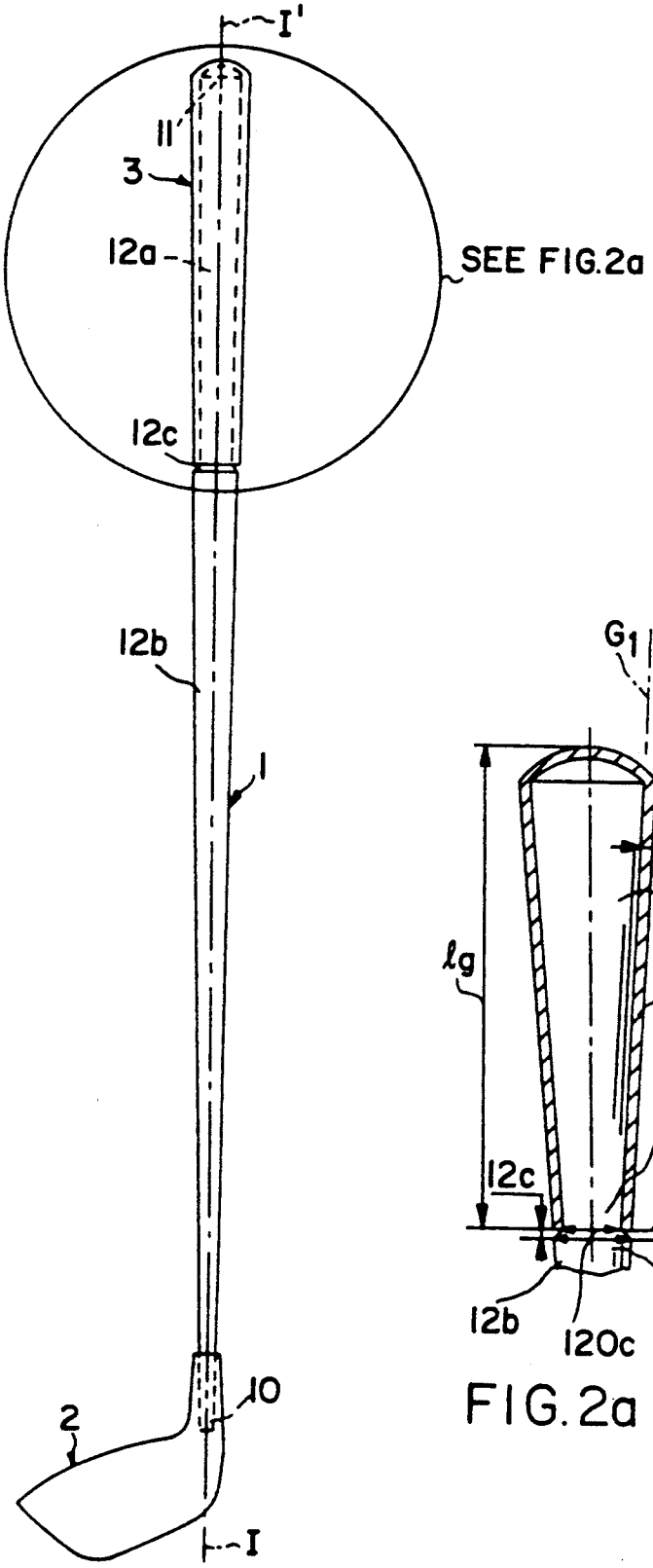
FIG. 2 is a view of a golf club according to the invention.

FIGS. 2 and and 2*a* illustrate a first embodiment of a club according It also incorporates the same assembly of a shaft 1, a head 2, and a grip 3. The shaft 1 is formed from several separate portions, including:

- a first, upper tapered portion 12*a* extending from the upper end 11 and covered at least partially by the grip 3;
- a second, lower portion 12*b* extending to the lower end 10; and
- a third, short connecting portion 12*c* which attaches the first portion 12*a* to the second portion 12*b*.

The lower end 120*a* of the first, upper tapered portion 12*a* has, at its lower end, a section having diameter d1, which is smaller than the diameter d2 of the section of the upper end 120*b* of the second, lower portion 12*b*.

In this first embodiment, the free part 121*b* of the second, lower portion 12*b* also advantageously has a tapered shape, and its generating line G2s is at least substantially parallel, to the generating line G1 of the first tapered portion 12*a*. The lower part 122*b* of the second portion, which is embedded in the head 2, is preferably a tubular portion having a uniform section.

Furthermore, the length of the first portion 12*a* is substantially equal to, or slightly less than, the length lg of the grip 3. In addition, the grip 3 has a tubular wall 30 preferably having a fine, uniform thickness 3 of approximately 1 to 2.5 mm, but possibly with a very slight variation of up to about 1 mm to meet molding capabilities, the thickness in that event being greater at the upper end. Moreover, the design could be such that the generating line Gg of the outer surface of the wall 30 merges with the generating line G2 of the free part 121*b* of the second, lower portion 12*b*. In this case, the grip 3 is incorporated into the shaft.

Figure 2A:
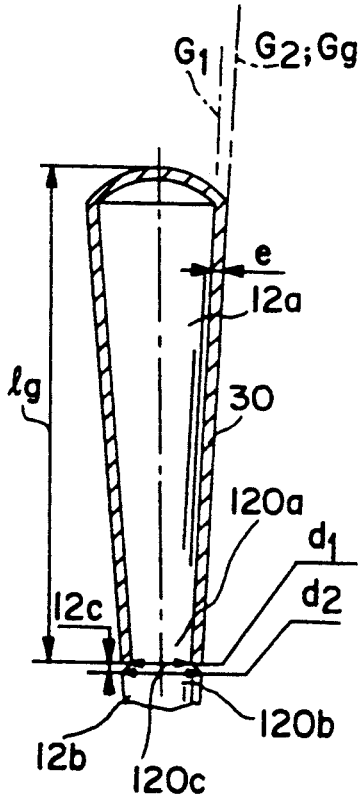
FIG. 2*a* is a view of detail of the grip of the club in FIG. 2.
Figure 2B:
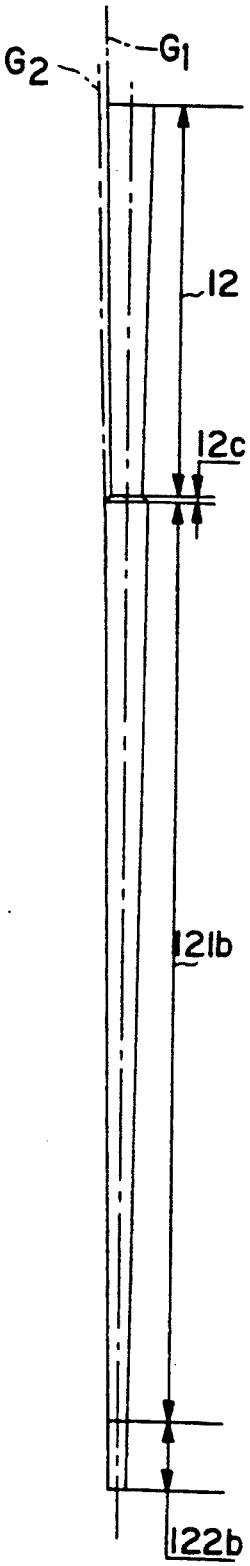
FIG. 2*b* is a view of a shaft of the club in FIG. 2.

FIG. 2*b* illustrates an example of a club shaft according to the invention. It is made of composite materials, by draping plies of fibers impregnated with duroplastic resin. The second portion 12*b* has, over at least a substantial length of its free part 121*b*, a section larger than the section of a conventional shaft, such as that shown in FIG. 1*b*, and this imparts to the shaft superior mechanical properties.

Figure 3:
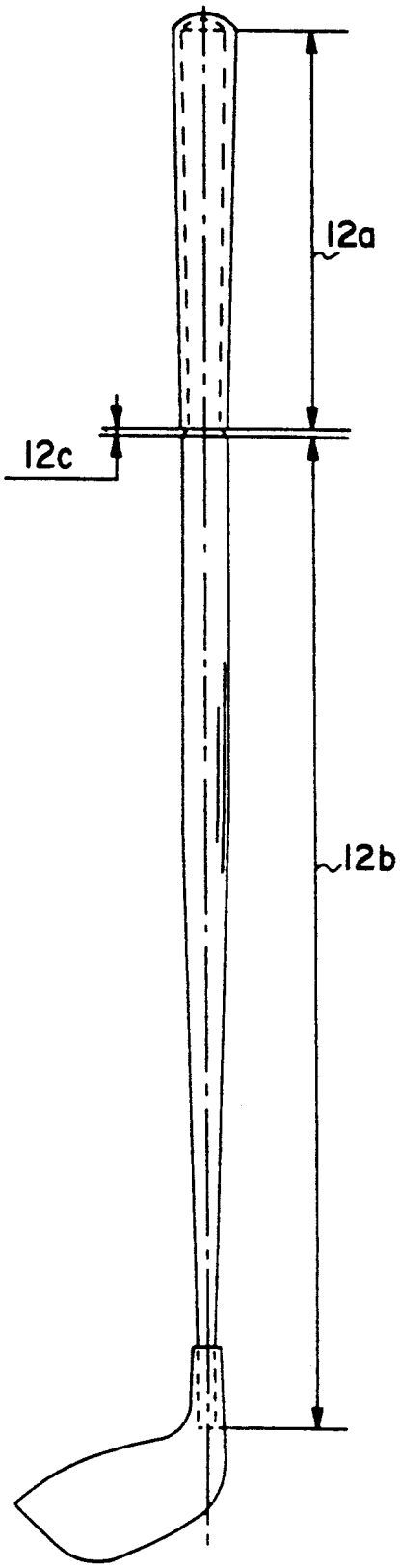
FIG. 3 is a view of a club according to a second embodiment of the invention.
Figure 3A:
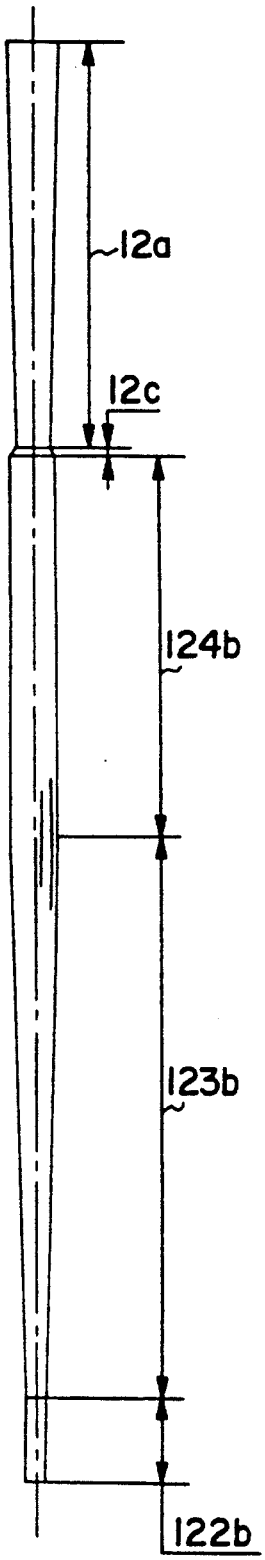
FIG. 3*a* is a detail view of the shaft of the club in FIG. 3.

FIGS. 3 and 3*a* illustrate a second embodiment of the invention, in which the shaft has a second, lower portion 12*b* whose geometry differs from that previously described in that it comprises a first, free lower tapered part 123*b* attached to a second, upper free part 124*b*, which has a uniform tubular section.

Figure 4:
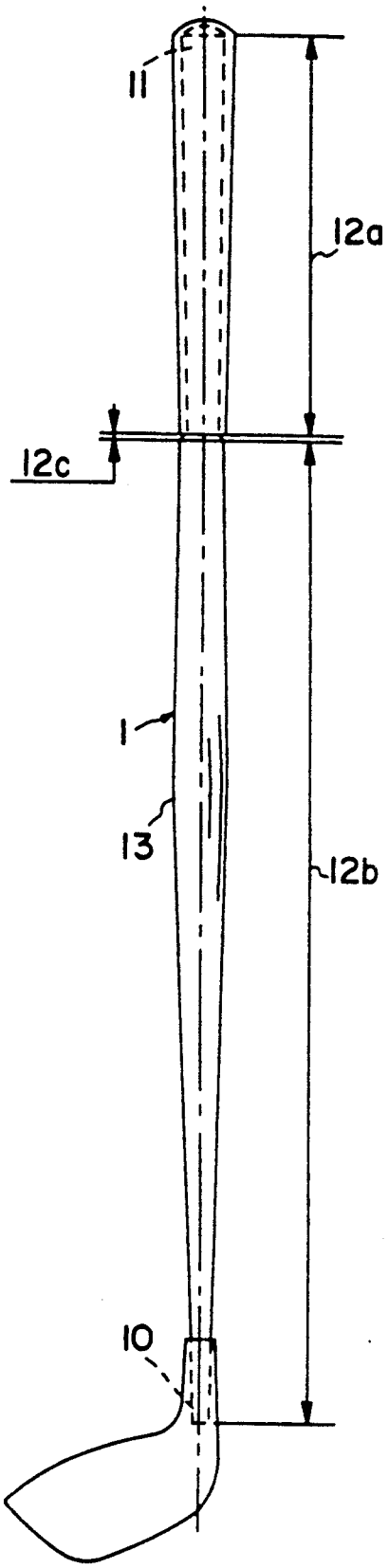
FIG. 4 is a view of another variant of the invention.
Figure 4A:
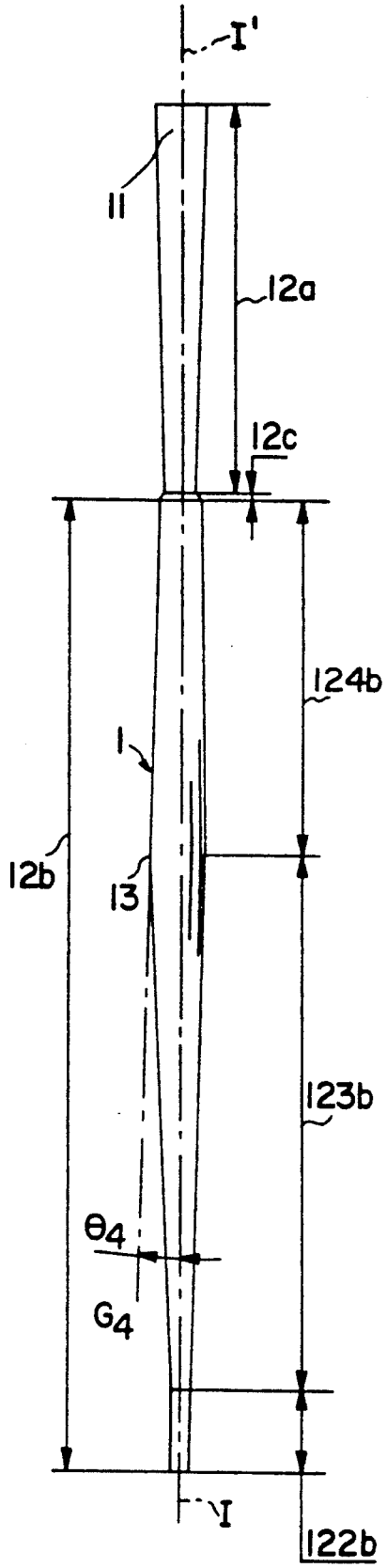
FIG. 4*a* is a view of a shaft of the club in FIG. 4.

FIGS. 4 and 4*a* illustrate a third embodiment of the invention, in which the shaft 1 has a second, lower portion 12*b* comprising a first, free upper part 124*b* in the shape of an truncated cone inverted in relation to the second, free lower part shaped like a truncated cone 123*b*, to which it is attached, so that the shaft 1 has a bulge 13 in approximately its median part. The phrase "shaped like an inverted truncated cone" signifies that the generating line G4 of the first, free upper part 124*b* forms, a negative angle $\theta 4$ relative to the axis I, I'.

Figure 5:
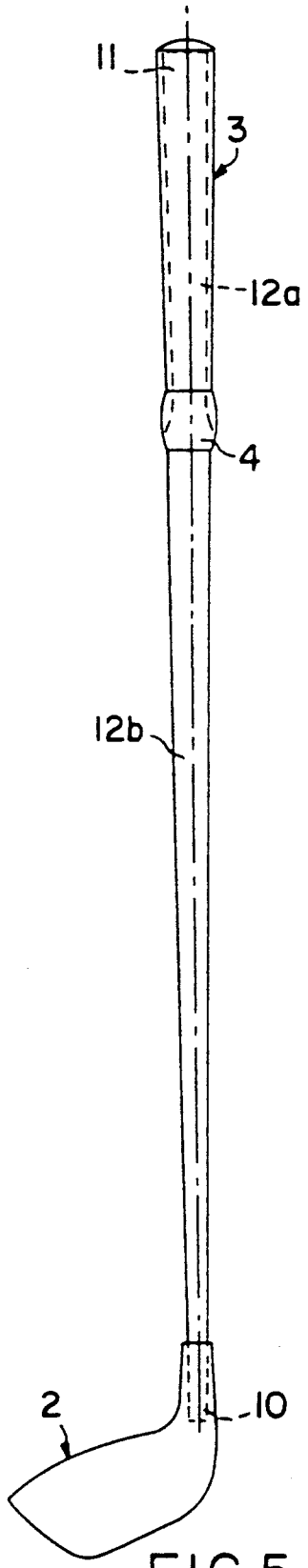
FIG. 5 is a view of a club incorporating another variant.
Figure 5A:
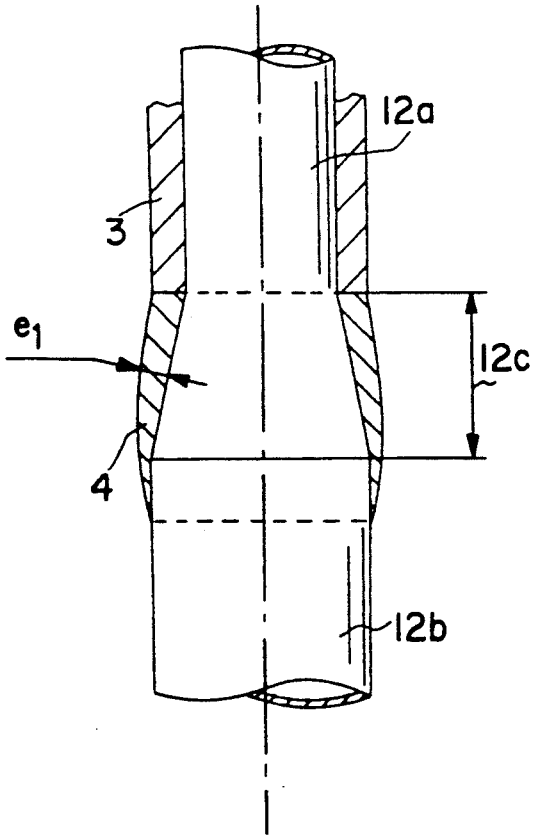
FIG. 5*a* is a detail view of the club in FIG. 4.

FIGS. 5 and 5*a* illustrate an improvement made to the embodiment of FIGS. 2 and 2*a*, consisting of the use of a ring 4 to cover the third, connecting portion 12*c*. The ring 4 is advantageously of variable thickness e1 and is thicker at its upper end, to protect the fine edge of the grip. This thickness is substantially equal to the thickness e of the grip, protect the grip on the shaft. The ring 4 may, be made of a material having damping properties, e.g., a viscoelastic material, and may have a variable weight according to the type of club, and thus be a factor contributing to the dynamic balancing of the club.

The shafts just described may advantageously be made by a process such as that described in French Patent Applications Nos. 90 15388 and 90 15387.

In the examples described, the generating lines are rectilinear, but they may incorporate a slight curvature, in particular for generating lines G1, G2, G3, and G4.

What is claimed is:

1. Golf club comprising: a shaft (1) made of a composite material, said golf club having a lower end (10) on which a head (2) is mounted, and an upper end (11) or grip end on which a grip (3) is mounted, said shaft having:

(a) a first, upper tapered portion (12*a*) extending from said upper end (11) toward said lower end (10) and at least partially covered by said grip (3);

(b) a second, lower portion (12*b*) extending from adjacent said first, upper tapered portion (12*a*) to said lower end (10); and (c) a third, short connecting portion (12*c*) which connects said first portion (12*a*) to said second portion (12*b*) and is located proximate to a section of a lower end of said first, upper tapered portion;

(d) the diameter (d1) of the section of said lower end (120*a*) of said first, upper tapered portion (12*a*) being less than the diameter (d2) of a section of an upper end (120*b*) of said second lower portion (12*b*).

2. A golf club according to claim 1, wherein said second, lower portion (12*b*) has a free, tapered part (121*b*).

3. A golf club according to claim 2, wherein a generating line (G2) of said free part (121*b*) of said second, lower portion (12*b*) is substantially parallel to a generating line (G1) of said first, upper portion (12*a*).

4. A golf club according to claim 1, wherein said second, lower portion (12*b*) has a first, free lower tapered part (123*b*) which is connected to a second, free upper part (124*b*) having a uniform tubular section.

5. A golf club according to claim 1, wherein said second, lower portion (12*b*) comprises a first, free upper part (124*b*) attached to a second, free lower tapered part (123*b*), said first, upper part (124*b*) having the shape of a truncated cone inverted relative to the shape of said second part (123*b*), so that said shaft (1) has a bulge (13) in a median part of said shaft.

6. A golf club according to claim 1, wherein said grip (3) comprises a tubular wall (30) of fine, uniform thickness covering said grip end (3). .

7. A golf club according to claim 6, wherein said tubular wall (30) has a thickness of between 1 and 2.5 mm.

8. A golf club according to claim 1, wherein said third, connecting portion (12*c*) is covered with a ring (4).

9. A golf club according to claim 1, wherein said ring (4) is made of a material with dampening properties.

* * * * *